US005078904A

United States Patent [19]

Behan et al.

[11] Patent Number: 5,078,904

[45] Date of Patent: Jan. 7, 1992

[54] FABRIC SOFTENING COMPOSITIONS CONTAINING MICRO ORGANISM ENCAPSULATED PERFUME

[75] Inventors: John M. Behan; Keith D. Perring, both of Ashford, Great Britain

[73] Assignee: Unilever Patent Holdings B.V., Rotterdam, Netherlands

[21] Appl. No.: 561,996

[22] Filed: Aug. 2, 1990

[30] Foreign Application Priority Data

Aug. 2, 1989 [GB] United Kingdom ..... 8917628

[51] Int. Cl.[5] ..... D06M 10/08; C11D 7/22

[52] U.S. Cl. ..... 252/8.6; 252/8.7; 252/8.8; 252/8.9; 252/174.11; 252/174.13

[58] Field of Search ..... 252/8.6–8.9, 252/174.11, 174.13

[56] References Cited

U.S. PATENT DOCUMENTS

| | | | |
|---|---|---|---|
| 4,001,480 | 1/1977 | Shank | 428/411 |
| 4,464,271 | 8/1984 | Munteanu | 252/8.6 |

FOREIGN PATENT DOCUMENTS

| | | |
|---|---|---|
| 0120528 | 10/1984 | European Pat. Off. . |
| 0214789 | 3/1987 | European Pat. Off. . |
| 242135 | 10/1987 | European Pat. Off. . |
| 2117094 | 7/1972 | France . |
| 2039556 | 8/1980 | United Kingdom . |
| 2162147 | 1/1986 | United Kingdom . |

*Primary Examiner*—Paul Lieberman
*Assistant Examiner*—William S. Parks
*Attorney, Agent, or Firm*—Cushman, Darby & Cushman

[57] ABSTRACT

The invention relates to perfumed fabric softening compositions wherein the perfume is encapsulated in micro-organism cells. Preferred micro-organisms for this purpose are yeasts, especially *Saccharomyces cerevisiae*, and filamentous fungi. The micro-organism cells preferably contain at least 15% w/w of perfume.

3 Claims, No Drawings

FABRIC SOFTENING COMPOSITIONS CONTAINING MICRO ORGANISM ENCAPSULATED PERFUME

The invention relates to perfumed fabric softening compositions. More particularly the invention relates to fabric softening compositions containing a perfume encapsulated in micro-organism cells.

Fabric softening compositions are used to impart softness and comfortable feel to fabrics after laundering and drying. They are generally added to the last rinse of the washing cycle. Some compositions are suitable to be added together with the detergent at the beginning of the washing cycle. Fabric softening compositions contain a softening agent, generally a cationic surfactant such as a quaternary ammonium salt, or a biodegradable softening agent, usually in an amount of between 1–40% by weight, as well as other additives such as rewetting agents, viscosity modifiers, optical brighteners, colouring agents etc. Fabric softening compositions are extensively described in the patent literature e.g. in U.S. Pat. No. 4,326,965, GB-B-2,039,556 and EPA-120,528. Conventionally a perfume is added to such compositions to impart an agreeable and fresh odour to the laundry. However these compositions have the disadvantage that a significant amount of the perfume is washed away with the rinse water and only a limited portion is actually retained by the cloth. Perfume components with a great tendency to adhere to fabric are known in the art, but the need to use only these in a perfume for fabric softeners greatly restricts the choice available to the creative perfumer.

Perfumed fabric softening compositions, comprising a softening agent have now been found which efficiently deliver the perfume to the cloth, wherein the perfume is encapsulated in micro-organism cells. The cells are retained by the fabric and gradually release the perfume during and after drying of the cloth. Additionally, perfume release is enhanced during ironing of the cloth, dispelling the unpleasant odour which is normally associated with ironing.

Preferred micro-organisms for the purpose of the invention are yeasts, particularly of the genus *Saccharomyces cerevisiae,* and filamentous fungi such as *Aspergillus niger.* Perfumes may be encapsulated in micro-organism cells according to methods known in the art such as described in U.S. Pat. No. 4,001,480 and in EP-A-242,135. Thus treated micro-organism cells may contain up to 75% perfume and preferably contain at least 15%, calculated on the total weight of the perfume containing cells. The amount of perfume containing cells (perfume encapsulate) to be added to a particular fabric softening composition depends on the perfume load in the cells and the amount of perfume that one desires to add to the product. The perfume content of a fabric softening composition usually lies in the range of 0.05–5% by weight, most commonly between 0.1 and 1%. and may be any commercially available perfume suitable for fabric softening compositions Fabric softening compositions according to the invention may be prepared according to procedures usual in the art and cover a wide range of concentrations of softening agents, generally between 1 and 40%. The encapsulated perfume may be added at any suitable stage. If at some stage during the preparation of the product the application of heat or vigorous mixing is involved, the perfume encapsulate is preferably added after that stage.

The invention is illustrated by the following examples, but not in any way limited thereto.

EXAMPLE 1

Preparation of perfume encapsulate

Dried baker's yeast (10g "Fermipan" ex Gist Brocades), water (40g) and a perfume (10g) were mixed together in a flask and maintained at a temperature of 40° C. for 4 hours whilst stirring at 250 rpm using a magnetic stirrer. The mixture was then centrifuged at 2000 rpm for 20 minutes. The bottom layer was obtained by decantation, and washed with a small quantity of distilled water in a Buchner funnel. Excess water was removed by suction and a thick slurry was obtained which was suitable for addition to aqueous fabric softening compositions. The slurry could be dried by prolonged suction (1 hour) followed by drying in a vacuum desiccator. The perfume content of the dried encapsulate (quantified by extraction of a sample with methanol followed by gc analysis) was found to be about 46% by weight.

Alternatively, the washed slurry was pumped to a spray-drier (Lab-Plant SD-03, downward spray nozzle 0.5 mm), where it was spray dried at an inlet temperature of 175°–180° C. and an outlet temperature of 100°–110° C. The perfume content of the dried encapsulate (quantified as specified above) was found to be about 42% by weight. Perfume encapsulates prepared according to this procedure were used to prepare fabric softening compositions.

EXAMPLE 2

A fabric softener base was prepared according to the following recipe:

| | % by weight |
|---|---|
| Arquad 2 HT | 5.00 |
| Isopropyl alcohol | 1.00 |
| Sodium chloride | 0.01 |
| Formalin | 0.04 |
| Orthophosphoric acid | 0.02 |
| Water | to 100. |

Perfumed fabric softening compositions were made by:

A—adding the perfume encapsulate slurry prepared according to EXAMPLE 1 to the liquid fabric softening base to give a perfume level of 0.35% by weight and stirring the mixture with a magnetic stirrer at 250 rpm for 2 hours to yield a homogeneous liquid;

B—adding the same perfume, but now as a neat liquid, to the liquid fabric softening base, again to give a perfume level of 0.35%.

30g samples of Terry towelling were rinsed in aqueous fabric softening solutions (500 ml, 0.25% w/w in tap water) made from the compositions described above, using a commercial Terg-O-tometer at 22° C. for 30 minutes. The cloths were assessed olfactorily during drying (line drying in air), when dry and finally immediately after ironing at medium heat. The results are summarized in Table 1 and show the beneficial effect of the perfume encapsulate.

TABLE 1

Olfactory assessment results for cloth treated with differently perfumed fabric softeners.

| Fabric softener | Olfactory Score (rank sum score)* after: 3 hrs drying | 30 hrs drying | ironing |
|---|---|---|---|
| Unperfumed | 29 | 24.5 | 27 |
| 0.35% perfume (neat liquid) | 17 | 20.5 | 20.5 |
| 0.35% perfume (as encapsulate) | 14 | 15 | 12.5 |

TABLE 1-continued

Olfactory assessment results for cloth treated with differently perfumed fabric softeners.

*10 Assessors, using a 3 point scale with 1 for the highest and 3 for the lowest odour intensity.

We claim:

1. Fabric softening compositions comprising a softening agent and a perfume wherein the perfume is encapsulated in micro-organism cells which are yeast or filamentous fungus cells, wherein the compositions contain a total perfume content of between 0.05 and 5% by weight and between 1 and 40% by weight of softening agent.

2. Fabric softening compositions according to claim 1 wherein the yeast is a *Saccharomyces cerevisiae.*

3. Fabric softening compositions according to claim 2 wherein the perfume content in the microorganism cells is at least 15% by weight of the perfume encapsulate.

* * * * *